US010006107B2

(12) United States Patent
Liang et al.

(10) Patent No.: US 10,006,107 B2
(45) Date of Patent: Jun. 26, 2018

(54) TITANIUM-ALLOY SUBSTRATE

(71) Applicant: HER CHANG TECHNOLOGY CO., LTD., Tainan County (TW)

(72) Inventors: Tien-Ken Liang, Tainan County (TW); Chun-Yung Huang, Tainan County (TW); Ming-Chia Tsai, Tainan County (TW); Weidong Xing, Tainan County (CN); Ning Zhang, Tainan County (CN)

(73) Assignee: HER CHANG TECHNOLOGY CO., LTD., Tainan County (TW)

( * ) Notice: Subject to any disclaimer, the term of this patent is extended or adjusted under 35 U.S.C. 154(b) by 474 days.

(21) Appl. No.: 14/862,297

(22) Filed: Sep. 23, 2015

(65) Prior Publication Data

US 2017/0081744 A1 Mar. 23, 2017

(51) Int. Cl.
*C22C 14/00* (2006.01)

(52) U.S. Cl.
CPC ..... *C22C 14/00* (2013.01)

(58) Field of Classification Search
CPC ..... C22C 14/00; C22F 1/183
See application file for complete search history.

*Primary Examiner* — Jessee Roe
(74) *Attorney, Agent, or Firm* — Jackson IPG PLLC; Demian K. Jackson

(57) ABSTRACT

The present invention discloses a titanium-alloy substrate which is formed plastically by performing die casting and forging to alloyed titanium at least one time. The present invention is characterized in that this titanium-alloy substrate is provided with a first structure layer which is arranged in a configuration of long axis crystal structure, and a second structure layer which is disposed on a side in adjacent to the first structure layer and is arranged in a configuration of equiaxed crystal structure.

28 Claims, 7 Drawing Sheets

| (Thickness) | <3mm | 3-8mm | >8mm |
|---|---|---|---|
| Granular Structure | Primary Long Axis Crystal（Long Axis Crystal > 40%） | Long Axis Crystal + Equiaxed Crystal（Long Axis Crystal > 20%） | Primary Equiaxed Crystal（Equiaxed Crystal > 50%） |
| Percentage % | Long Axis Crystal 80% Equiaxed Crystal 20% | Long Axis Crystal 40% Equiaxed Crystal 60% | Long Axis Crystal 10% Equiaxed Crystal 90% |
| Effect and Application Product | For products able to sustain with local static stress and with ability of high anti-deformation and high anti-wear, such as a housing of 3C cell phone or a housing of watch | For products able to sustain with local stress and high dynamic load, such as a Golf club striking surface or sport equipment | For products able to sustain with high dynamic load or requiring ability of high anti-tension, such as an automobile or motorcycle part or a hardware part |

FIG.3

TITANIUM-ALLOY SUBSTRATE

BACKGROUND OF THE INVENTION a) Field of the Invention

The present invention relates to a titanium-alloy substrate, and more particularly to a titanium-alloy substrate, material properties of which can be easily adjusted through a simple machining treatment.

b) Description of the Prior Art

A conventional small metal fitting, such as sport equipment (Golf head, striking surface), a housing structure (housing of an electronic part, housing of a watch), a small hardware part, and automobile or motorcycle part, will be manufactured by a technology of precision casting or precision die forging to achieve the expected structural strength as well as to meet the processing cost and the capacity.

For example, a metallic material is prefabricated into an embryo in a predetermined shape by the method of precision casting or precision die forging. The embryo is used as a substrate for the product to be processed in accordance with a predetermined specification or the embryo is further implemented with a procedure of surface machining at least one time to form the substrate in the predetermined specification, so as to be further processed into all kinds of finished product (alloy product).

Among the existing metallic materials, as being provided with the advantages of noble metal and base metal (such as high strength, anti-corrosion, light weight, good bio-compatibility, low thermal conductivity, good ductility, and no harm to human bodies), titanium alloy is specially suitably processed into a titanium-alloy product, such as a Golf head, a striking surface, a housing of an electronic part, a housing of a watch, a small hardware part, an automobile or motorcycle part, and even an artificial implant.

Moreover, depending upon the function and the purpose of titanium-alloy products, in the application end of processing titanium alloy into the titanium-alloy products, the shape and dimension of the titanium-alloy products will be usually determined by the processing procedure of stamping, cutting, grinding, or even surface treatment. On the other hand, in addition to that the titanium-alloy substrate should be provided with the structural strength required by the final titanium-alloy product, it is preferred that the titanium-alloy substrate is also provided with the advantage of convenience in the processing. Accordingly, it has been always an issue to be solved eagerly by the industry and the academic society to provide a titanium-alloy substrate, with that the material properties of the titanium-alloy substrate can be easily adjusted according to the requirement through the simple machining treatment in the application end of the processing.

SUMMARY OF THE INVENTION

To solve the abovementioned issue in the prior art, the primary object of the present invention is to provide a titanium-alloy substrate, the material properties of which can be easily adjusted through the simple machining treatment.

Accordingly, the present invention discloses a titanium-alloy substrate which is formed plastically by performing cast molding to alloyed titanium at least one time, wherein this titanium-alloy substrate is provided with a first structure layer which is arranged in a configuration of long axis crystal structure, and a second structure layer which is disposed on a side in adjacent to the first structure layer and is arranged in a configuration of equiaxed crystal structure.

Accordingly, the present invention discloses a titanium-alloy substrate which is formed plastically by performing cast molding to alloyed titanium at least one time, wherein this titanium-alloy substrate is provided with a first structure layer which is arranged in a configuration of long axis crystal structure, and a second structure layer which is disposed on a side in adjacent to the first structure layer and is arranged in a configuration of equiaxed crystal structure, with an included angle of 30°~90° being formed between the first structure layer and the substrate surface.

Accordingly, the present invention discloses a titanium-alloy substrate which is formed plastically by performing cast molding to alloyed titanium at least one time, wherein this titanium-alloy substrate is provided with a first structure layer which is arranged in a configuration of long axis crystal structure and takes up more than 10% of volume in all titanium-alloy substrate, as well as a second structure layer which is arranged in a configuration of equiaxed crystal structure and takes up more than 10% of volume in all titanium-alloy substrate.

By the abovementioned structures, the titanium-alloy substrate of the present invention can be manifested as a configuration of plate or slab in a predetermined thickness or as a configuration of embryo in a predetermined shape, according to the shipping or processing need. In using the titanium-alloy substrate, based upon the practical need of the titanium-alloy product to which the entire titanium-alloy substrate is applied, all of the first structure layers can be reserved optionally, or a part or all of the first structure layer can be removed at a specific location of the titanium-alloy product through a simple processing of grinding or cutting or through a gate design, so as to achieve the object of adjusting the material properties easily.

By the abovementioned structures, the thickness of the titanium-alloy substrate can be less than 3 mm, and the first structure layer can take up more than 40% of volume in all titanium-alloy substrate.

By the abovementioned structures, the first structure layer can take up 80% of volume in all titanium-alloy substrate, and the second structure layer can take up 20% of volume in all titanium-alloy substrate.

By the abovementioned structures, the thickness of the titanium-alloy substrate can be between 3 mm and 8 mm, and the first structure layer can take up more than 20% of volume in all titanium-alloy substrate.

By the abovementioned structures, the first structure layer can take up 40% of volume in all titanium-alloy substrate, and the second structure layer can take up 60% of volume in all titanium-alloy substrate.

By the abovementioned structures, the thickness of the titanium-alloy substrate can be larger than 8 mm, and the second structure layer can take up more than 50% of volume in all titanium-alloy substrate.

By the abovementioned structures, the first structure layer can take up 10% of volume in all titanium-alloy substrate, and the second structure layer can take up 90% of volume in all titanium-alloy substrate.

By the abovementioned structures, the second structure layer can be disposed on an outer surface layer at a side in adjacent to the first structure layer.

By the abovementioned structures, the second structure layer can be disposed on a local outer surface layer in adjacent to the first structure layer.

By the abovementioned structures, the second structure layer can be disposed on a neighboring side inside the first structure layer.

Accordingly, the titanium-alloy substrate of the present invention is provided with the advantage of adjusting the material properties of the application end easily, thereby reducing the difficulty in processing and the processing cost of the application end. In particular, the titanium-alloy substrates in various thickness grades and the percentages of the second structure layers corresponding to the various thickness grades can be prefabricated depending upon the processing need of various titanium-alloy products, in order to facilitate choosing directly the titanium-alloy substrate in a proper thickness grade to be used in the application end. Therefore, the processing cost of the titanium-alloy product can be reduced and the processing quality of the titanium-alloy product can be assured by using a more aggressive and reliable means.

To enable a further understanding of the said objectives and the technological methods of the invention herein, the brief description of the drawings below is followed by the detailed description of the preferred embodiments.

BRIEF DESCRIPTION OF THE DRAWINGS

FIG. 3 shows a schematic view of all kinds of product for all kinds of structural configuration of the titanium-alloy substrate, according to the present invention.

DETAILED DESCRIPTION OF THE PREFERRED EMBODIMENTS

Figure 1:
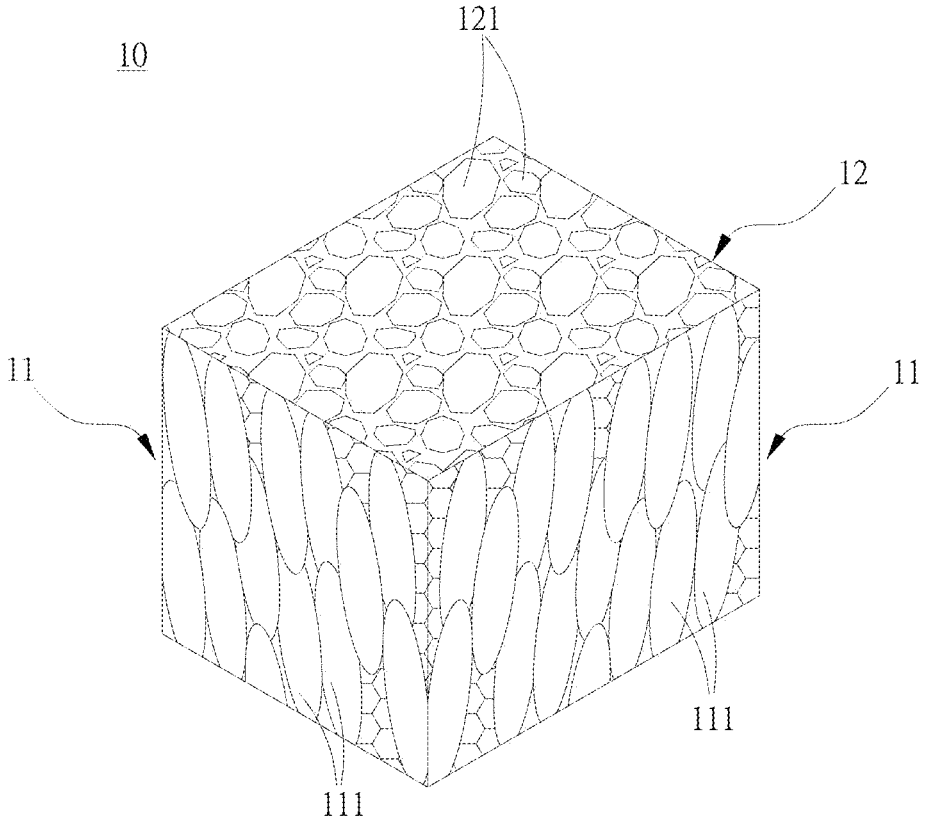
FIG. 1 shows a structural schematic view of a titanium-alloy substrate, according to the present invention.
Figure 2:
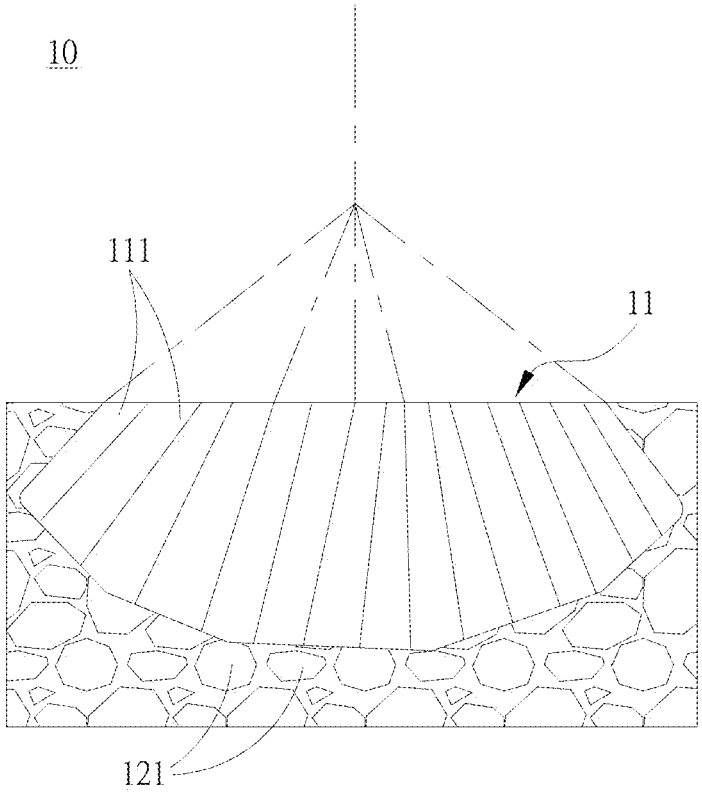
FIG. 2 shows a structural cutaway view of the titanium-alloy substrate, according to the present invention.

Referring to FIG. 1 and FIG. 2, it shows a structural schematic view and a structural cutaway view of a titanium-alloy substrate of the present invention, respectively. As shown in FIG. 1, this titanium-alloy substrate 10 is formed plastically by performing cast molding to alloyed titanium at least one time, wherein the material properties of the titanium-alloy substrate 10 can be easily adjusted through a simple machining treatment. The titanium-alloy substrate 10 is provided with a first structure layer 11 which is arranged in a configuration of long axis crystal structure 111, and a second structure layer 12 which is disposed on a side in adjacent to the first structure layer 11 and is arranged in a configuration of equiaxed crystal structure 121. Furthermore, the titanium-alloy substrate 10 can be processed that an included angle is formed between the first structure layer 11 and a substrate surface, as shown in FIG. 2, wherein it is preferred that the included angle is, but not limited to, between 30° and 90°. On the other hand, in structure disposition, it is preferred that the first structure layer 11 takes up more than 10% of volume in all of the titanium-alloy substrate 10, and the second structure layer 12 takes up more than 20% of volume in all of the titanium-alloy substrate 10.

Upon implementation, a metallic mold is provided and assembled into a casting chamber, and then the alloyed titanium is put into a smelting chamber. The alloyed titanium in the smelting chamber is heated up in vacuum, and when the metallic material in the smelting chamber is melted down, the casting chamber is vacuumized. After that, the melted alloyed titanium is filled into the metallic mold and a hinge press system is activated to drive the metallic mold to press the melted alloyed titanium, thereby forming the alloyed titanium plastically through the abovementioned cast molding. After the alloyed titanium has been cooled down, the titanium-alloy substrate 10 will be formed as shown in FIG. 1.

In principle, the titanium-alloy substrate 10 of the present invention can be manifested as a configuration of plate or slab in a predetermined thickness or as a configuration of embryo in a predetermined shape, depending upon the shipping or processing need. In using the titanium-alloy substrate 10, based upon the practical need of the titanium-alloy product to which the entire titanium-alloy substrate 10 is applied, all of the first structure layers 11 can be reserved optionally, or a part or all of the first structure layers 11 can be removed at a specific location of the titanium-alloy product through a simple processing of grinding or cutting or through a gate design, so as to achieve the object of adjusting the material properties easily.

Figure 4:
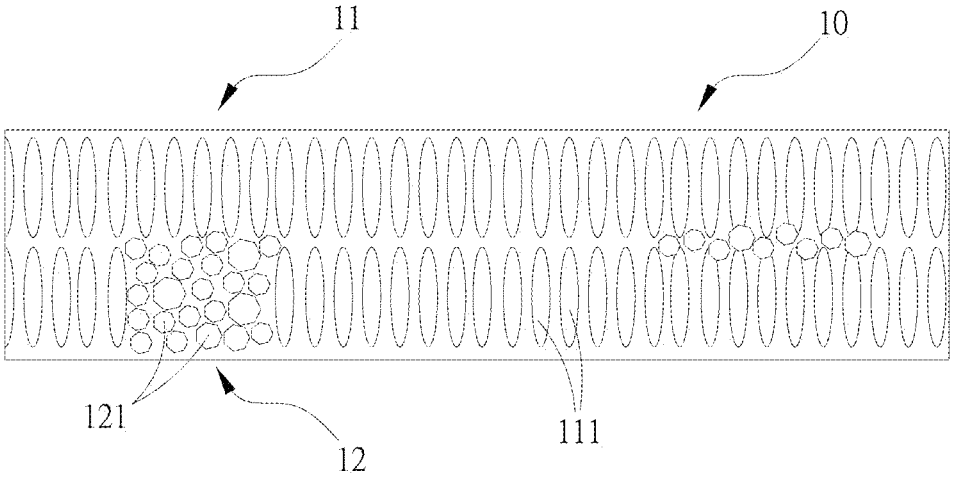
FIG. 4 shows a first local cutaway view of that the titanium-alloy substrate is processed into a titanium-alloy striking surface of a Golf club, according to the present invention.
Figure 5:
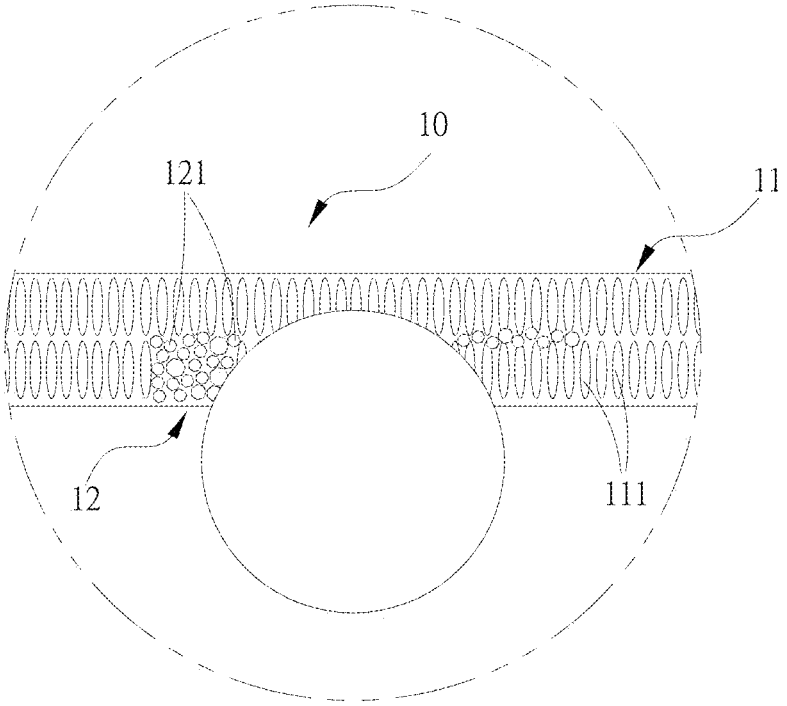
FIG. 5 shows a second local cutaway view of that the titanium-alloy substrate is processed into a titanium-alloy striking surface of a Golf club, according to the present invention.
Figure 6:
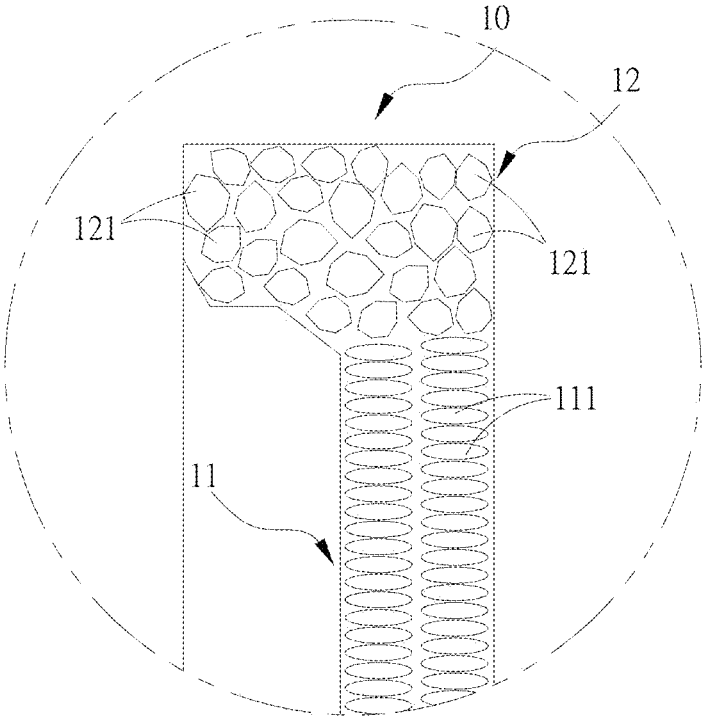
FIG. 6 shows a local cutaway view of that the titanium-alloy substrate is processed into a titanium-alloy housing of a watch, according to the present invention.
Figure 7:
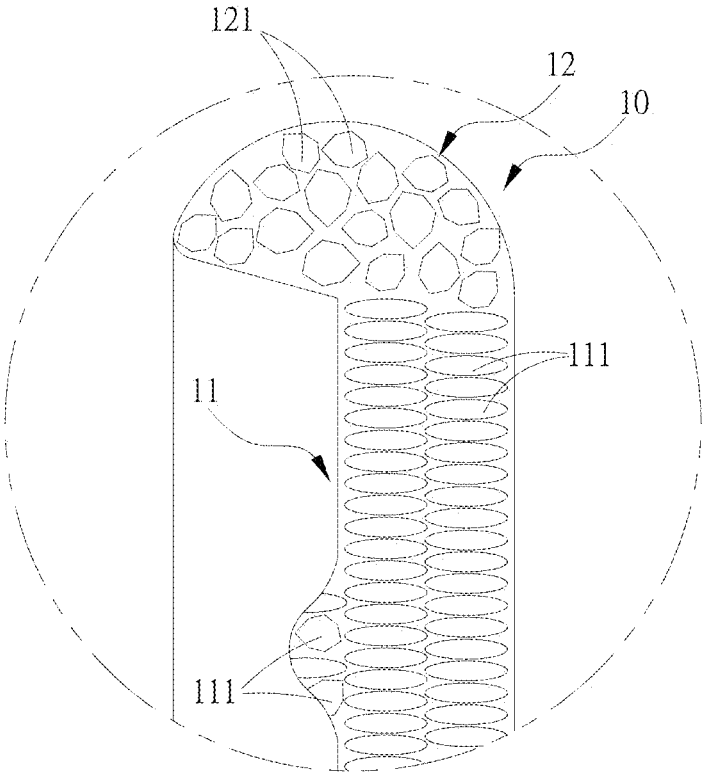
FIG. 7 shows a local cutaway view of that the titanium-alloy substrate is processed into a titanium-alloy housing of a cell phone, according to the present invention.

For example, if the titanium-alloy product to be processed requires a higher mechanical structure strength, all of the second structure layers 12 of the titanium-alloy substrate 10 can be reserved optionally, and then the titanium-alloy substrate 10 is processed into the titanium-alloy product in a predetermined size by a machine cutting method, such as a Golf club striking surface in FIG. 4 and FIG. 5, a housing of a watch in FIG. 6, or a housing of a cell phone in FIG. 7.

Moreover, if the titanium-alloy product to be processed does not require specifically the mechanical structure strength but instead focuses on other material advantages of titanium alloy, then a part or all of the second structure layers can be removed through a simple treatment of grinding or cutting, allowing the titanium-alloy substrate 10 to be more suitable for being fabricated into the titanium-alloy product in a predetermined size by stamping or sheet-metal working equipment which is equipped with a low kinetic energy.

It is worthy of mentioning that the titanium-alloy substrates in various thickness grades, various locations for disposing the second structure layers and the percentages of the second structure layers corresponding to the various thickness grades can be prefabricated based upon the processing need of various titanium-alloy products, in order to facilitate choosing directly a proper titanium-alloy substrate to be used in the application end. For example, as shown in FIG. 3, when the titanium-alloy substrate is to be applied to a housing of a cell phone or a housing of a watch, which needs to sustain with a high compression stress and deformation, the type of structure for the titanium-alloy substrate can be that the thickness is less than 3 mm, the first structure layer takes up more than 40% of volume in all of the titanium-alloy substrate, and it is preferred that first structure layer takes up 80% of volume in all of the titanium-alloy substrate, whereas the second structure layer takes up 20% of volume in all of the titanium-alloy substrate. The type of structure for the titanium-alloy substrate can be also that the thickness is between 3 mm and 8 mm, the first structure layer takes up more than 20% of volume in all of the titanium-alloy substrate, and it is preferred that the first structure layer takes up 40% of volume in all of the titanium-alloy substrate, whereas the second structure layer takes up 60% of volume in all of the titanium-alloy substrate. The type of structure for the titanium-alloy substrate can be further that the thickness is larger than 8 mm, the second structure layer takes up more than 50% of volume in all of the titanium-alloy substrate, and it is preferred that the first structure layer takes up 10% of volume in all of the titanium-alloy substrate, whereas the second structure layer takes up 90% of volume in all of the titanium-alloy substrate. On the other hand, in terms of the disposition of the second structure layer, the second structure layer can be, but not limited to, disposed on an outer surface layer at a side in adjacent to the first structure layer, on a local outer surface layer in adjacent to the first structure layer, or on a neighboring side inside the first structure layer.

Comparing with the prior art, the titanium-alloy substrate disclosed by the present invention is equipped with the advantage of adjusting the material properties of the application end easily. Therefore, the difficulty in processing and the processing cost of the application end can be reduced. In particular, the titanium-alloy substrates in various thickness grades and with the percentages of the second structure layers corresponding to the thickness grades can be even prefabricated based upon the processing need of various titanium-alloy products, so as to facilitate choosing directly the titanium-alloy substrate in a proper thickness grade to be used in the application end. Accordingly, the processing cost of the titanium-alloy product can be reduced and the processing quality of the titanium-alloy product can be assured by using a relatively more aggressive and reliable means.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A titanium-alloy substrate, being formed plastically by performing cast molding to alloyed titanium at least one time, wherein the titanium-alloy substrate is provided with a first structure layer which is arranged in a configuration of long axis crystal structure and a second structure layer which is disposed on a side in adjacent to the first structure layer and is arranged in a configuration of equiaxed crystal structure.

2. The titanium-alloy substrate according to claim 1, wherein the thickness of titanium-alloy substrate is less than 3 mm, and the first structure layer takes up more than 40% of volume in all of the titanium-alloy substrate.

3. The titanium-alloy substrate according to claim 2, wherein the first structure layer takes up 80% of volume in all of the titanium-alloy substrate, and the second structure layer takes up 20% of volume in all of the titanium-alloy substrate.

4. The titanium-alloy substrate according to claim 1, wherein the thickness of titanium-alloy substrate is between 3 mm and 8 mm, and the first structure layer takes up more than 20% of volume in all of the titanium-alloy substrate.

5. The titanium-alloy substrate according to claim 4, wherein the first structure layer takes up 40% of volume in all of the titanium-alloy substrate, and the second structure layer takes up 60% of volume in all of the titanium-alloy substrate.

6. The titanium-alloy substrate according to claim 1, wherein the thickness of titanium-alloy substrate is larger than 8 mm, and the second structure layer takes up more than 50% of volume in all of the titanium-alloy substrate.

7. The titanium-alloy substrate according to claim 6, wherein the first structure layer takes up 10% of volume in all of the titanium-alloy substrate, and the second structure layer takes up 90% of volume in all of the titanium-alloy substrate.

8. The titanium-alloy substrate according to claim 1, wherein the second structure layer is disposed on an outer surface layer at a side in adjacent to the first structure layer.

9. The titanium-alloy substrate according to claim 1, wherein the second structure layer is disposed on a local outer surface layer in adjacent to the first structure layer.

10. The titanium-alloy substrate according to claim 1, wherein the second structure layer is disposed on a neighboring side inside the first structure layer.

11. A titanium-alloy substrate, being formed plastically by performing cast molding to alloyed titanium at least one time, wherein the titanium-alloy substrate is provided with a first structure layer which is arranged in a configuration of long axis crystal structure and a second structure layer which is disposed on a side in adjacent to the first structure layer and is arranged in a configuration of equiaxed crystal structure, with an included angle of 30°~90° being formed between the first structure layer and the substrate surface.

12. The titanium-alloy substrate according to claim 11, wherein an included angle of 80°~90° is formed between the first structure layer and the substrate surface.

13. The titanium-alloy substrate according to claim 11, wherein the thickness of titanium-alloy substrate is less than 3 mm, and the first structure layer takes up more than 40% of volume in all of the titanium-alloy substrate.

14. The titanium-alloy substrate according to claim 13, wherein the first structure layer takes up 80% of volume in all of the titanium-alloy substrate, and the second structure layer takes up 20% of volume in all of the titanium-alloy substrate.

15. The titanium-alloy substrate according to claim 11, wherein the thickness of titanium-alloy substrate is between 3 mm and 8 mm, and the first structure layer takes up more than 20% of volume in all of the titanium-alloy substrate.

16. The titanium-alloy substrate according to claim 15, wherein the first structure layer takes up 40% of volume in all of the titanium-alloy substrate, and the second structure layer takes up 60% of volume in all of the titanium-alloy substrate.

17. The titanium-alloy substrate according to claim 11, wherein the thickness of titanium-alloy substrate is larger than 8 mm, and the second structure layer takes up more than 50% of volume in all of the titanium-alloy substrate.

18. The titanium-alloy substrate according to claim 17, wherein the first structure layer takes up 10% of volume in all of the titanium-alloy substrate, and the second structure layer takes up 90% of volume in all of the titanium-alloy substrate.

19. A titanium-alloy substrate, being formed plastically by performing cast molding to alloyed titanium at least one time, wherein the titanium-alloy substrate is provided with a first structure layer which is arranged in a configuration of long axis crystal structure and takes up more than 10% of volume in all of the titanium-alloy substrate, as well as a second structure layer which is arranged in a configuration of equiaxed crystal structure and takes up more than 20% of volume in all of the titanium-alloy substrate.

20. The titanium-alloy substrate according to claim 19, wherein the thickness of titanium-alloy substrate is less than 3 mm, and the first structure layer takes up more than 40% of volume in all of the titanium-alloy substrate.

21. The titanium-alloy substrate according to claim 20, wherein the first structure layer takes up 80% of volume in all of the titanium-alloy substrate, and the second structure layer takes up 20% of volume in all of the titanium-alloy substrate.

22. The titanium-alloy substrate according to claim 19, wherein the thickness of titanium-alloy substrate is between 3 mm and 8 mm, and the first structure layer takes up more than 20% of volume in all of the titanium-alloy substrate.

23. The titanium-alloy substrate according to claim 22, wherein the first structure layer takes up 40% of volume in all of the titanium-alloy substrate, and the second structure layer takes up 60% of volume in all of the titanium-alloy substrate.

24. The titanium-alloy substrate according to claim 19, wherein the thickness of titanium-alloy substrate is larger than 8 mm, and the second structure layer takes up more than 50% of volume in all of the titanium-alloy substrate.

25. The titanium-alloy substrate according to claim 24, wherein the first structure layer takes up 10% of volume in all of the titanium-alloy substrate, and the second structure layer takes up 90% of volume in all of the titanium-alloy substrate.

26. The titanium-alloy substrate according to claim 19, wherein the second structure layer is disposed on an outer surface layer at a side in adjacent to the first structure layer.

27. The titanium-alloy substrate according to claim 19, wherein the second structure layer is disposed on a local outer surface layer in adjacent to the first structure layer.

28. The titanium-alloy substrate according to claim 19, wherein the second structure layer is disposed on a neighboring side inside the first structure layer.

* * * * *